US006670099B2

(12) United States Patent
Sawada et al.

(10) Patent No.: US 6,670,099 B2
(45) Date of Patent: Dec. 30, 2003

(54) SUPPORT FOR LITHOGRAPHIC PRINTING PLATE AND METHOD OF MANUFACTURING THE SAME

(75) Inventors: Hirokazu Sawada, Shizuoka (JP); Atsuo Nishino, Shizuoka (JP); Akio Uesugi, Shizuoka (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 70 days.

(21) Appl. No.: 09/946,477

(22) Filed: Sep. 6, 2001

(65) Prior Publication Data

US 2002/0048714 A1 Apr. 25, 2002

(30) Foreign Application Priority Data

Sep. 6, 2000 (JP) ..... 2000-270135

(51) Int. Cl.[7] ..... B41N 3/03
(52) U.S. Cl. ..... 430/278.1; 205/640; 101/459
(58) Field of Search ..... 428/687; 205/640; 430/278.1; 101/459

(56) References Cited

U.S. PATENT DOCUMENTS 4,729,939 A * 3/1988 Nishikawa et al. ..... 430/278.1
5,104,743 A * 4/1992 Nishikawa et al. ..... 428/472.2
5,462,614 A * 10/1995 Sawada et al. ..... 148/551
6,194,082 B1 * 2/2001 Sawada et al. ..... 428/610
6,264,821 B1 * 7/2001 Nishino et al. ..... 205/660
6,387,198 B1 * 5/2002 Suzuki et al. ..... 148/692
2002/0094490 A1 * 7/2002 Endo et al. ..... 430/278.1

FOREIGN PATENT DOCUMENTS

EP 0257957 A1 * 3/1988
JP 61-146598 * 7/1986
JP 62-146694 * 6/1987
JP 2-293189 * 12/1990

* cited by examiner

*Primary Examiner*—John J. Zimmerman
(74) *Attorney, Agent, or Firm*—Burns, Doane, Swecker & Mathis, LLP

(57) ABSTRACT

A support for a lithographic printing plate with no damage in appearance such as unevenness in the form of streaks and with excellent pit homogeneity. A support for a lithographic printing plate obtained by subjecting a surface of an aluminum alloy plate to a surface treatment including alkali etching and an electrochemical graining treatment, wherein the aluminum alloy plate shows dispersion of 50% or lower for each element, the dispersion being defined by an specific equation with regard to contents of Fe, Si, Mn, Mg and Sn in a surface layer portion thereof which is from the surface to a depth of 1 $\mu$m.

4 Claims, No Drawings

SUPPORT FOR LITHOGRAPHIC PRINTING PLATE AND METHOD OF MANUFACTURING THE SAME

BACKGROUND OF THE INVENTION

1. Field of the Invention

The present invention relates to a support for a lithographic printing plate and a method of manufacturing the same, more particularly, to a support for a lithographic printing plate showing an excellent printing performance in which no unevenness in the form of streaks and the like occurs on a surface thereof, and in which uniform electrolytically grained pits are formed efficiently by an electrochemical graining treatment. The present invention also relates to a method of manufacturing the same.

2. Description of the Related Arts

Heretofore, an aluminum alloy plate has been used as a support for a lithographic printing plate. The aluminum alloy plate undergoes a graining treatment in order to acquire adhesion to a photosensitive layer and water receptivity in non-image areas.

Methods of graining that are known heretofore include: a mechanical graining method such as ball graining and brush graining; an electrochemical graining method in which a surface of an aluminum alloy plate undergoes electrolytic graining by using an electrolytic solution mainly containing hydrochloric acid, nitric acid or the like; and a chemical graining method in which a surface of an aluminum alloy plate undergoes etching by an acid solution or an alkaline solution. In recent years, graining by using a combination of the electrochemical graining method and the other graining methods has been becoming the mainstream, since a grained surface obtained by the electrochemical graining method has homogeneous pits and an excellent printing performance.

However, there have been cases where an, appearance defect such as unevenness in the form of streaks occurs on the surface after the electrochemical graining treatment and also homogeneity of pits on the surface after the electrochemical graining treatment is damaged.

Unevenness in the form of streaks is a streak-like unevenness that appears on the surface after the electrochemical graining treatment. Although it has no adverse effect on the printing performance, it makes a plate checking operation difficult during the course of printing and thus the supports with unevenness in the form of streaks are screened out for their appearance defect.

Also, poor homogeneity of the pits has an adverse effect on the printing performance; therefore, homogeneity of pits is required for the supports.

SUMMARY OF THE INVENTION

Accordingly, an object of the present invention is to provide a support for a lithographic printing plate which has no appearance defect such as unevenness in the form of streaks and is excellent in pit homogeneity, and to provide a method of manufacturing the same.

As a result of diligent studies in an attempt to achieve the foregoing object, no features were found regarding element segregation in portions of the support where the unevenness in the form of streaks occurred. When an aluminum surface of the backside of the support for a lithographic printing plate with the unevenness in the form of streaks was investigated, it was found that there was a large degree of dispersion in content of certain elements. Then, the outermost surface layer portion of the aluminum alloy plate before performing a surface treatment was investigated again. As a result, it was found that the dispersion of element contents in the outermost surface layer portion has an influence on uniformity of the surface (about 2 mm to 5 mm from the surface layer) that has been subjected to alkaline etching treatment and the electrochemical graining treatment. Thus, the present invention was accomplished.

Therefore, the present invention provides a support for a lithographic printing plate obtained by subjecting a surface of an aluminum alloy plate to a surface treatment including alkali etching and an electrochemical graining treatment, wherein the aluminum alloy plate shows dispersion of 50% or lower for each element, the dispersion being defined by an equation (1) below with regard to contents of Fe, Si, Mn, Mg and Sn in a surface layer portion thereof which is from the surface to a depth of 1 $\mu$m:

$$\text{dispersion}(\%)=(\text{maximum value}-\text{minimum value})/\text{average value}\times 100(\%) \quad (1),$$

where the maximum, minimum and average values are determined based on eight pieces of element content data resulting from excluding the largest and smallest values from ten pieces of element content data obtained by performing an elemental analysis at ten locations.

Preferably, said aluminum alloy plate shows dispersion of 30% or lower for each element, the dispersion being defined by the equation (1) below with regard to the contents of Fe, Si, Mn, Mg and Sn in a portion thereof located at a depth of 2 $\mu$m to 5 $\mu$m from the surface:

$$\text{dispersion}(\%)=(\text{maximum value}-\text{minimum value})/\text{average value}\times 100(\%) \quad (1),$$

where the maximum, minimum and average values are determined based on eight pieces of element content data resulting from excluding the largest and smallest values from ten pieces of element content data obtained by performing an element analysis at ten locations.

The present invention also provides a method of manufacturing a support for a lithographic printing plate, comprising subjecting the surface of said aluminum alloy plate to alkali etching followed by an electrochemical graining treatment.

DETAILED DESCRIPTION OF THE PREFERRED EMBODIMENTS

Hereinafter, the present invention will be described in detail.

An aluminum alloy plate used for a support for a lithographic printing plate of the present invention has dispersion of 50% or lower, preferably 40% or lower, for each element, the dispersion being defined by equation (1) below with regard to contents of Fe, Si, Mn, Mg and Sn in a surface layer portion which is from the surface to a depth of 1 $\mu$m:

$$\text{dispersion}(\%)=(\text{maximum value}-\text{minimum value})/\text{average value}\times 100(\%) \quad (1),$$

where the maximum, minimum and average values are determined based on eight pieces of element content data resulting from excluding the largest and smallest values from ten pieces of element content data obtained by performing an element analysis at ten locations. Herein, the elementary analysis is carried out as follows, for example. First, the aluminum alloy plate is sequentially subjected to alkali etching, rinsing and a desmutting treatment so as to expose a surface at a certain depth from the surface thereof. The exposed surface is rinsed in acetone and dried. The analysis is then performed by using a solid state light emission analyzer at ten locations, the measurement locations being separated from each other by a distance of no less than 2 cm.

When the dispersion of contents of Fe, Si, Mn, Mg and Sn in the surface layer portion from the surface to the depth of 1 μm is in the above-described range, there will be no occurrence of appearance defect such as unevenness in the form of streaks on the surface by the electrochemical graining treatment conducted thereafter or damage of homogeneity of the pits by the electrochemical graining treatment, since unevenness is not likely to occur during alkali etching.

The present inventors found the cause of dispersion of the contents of these elements. The dispersion occurs due to intermetallic compounds consisting of each of the elements, for example, α-AlFeSi, α-AlFeMnSi, $Mg_2Si$, $Al_3Fe$ and $Al_6Fe$, being large-sized and uneven distribution of the intermetallic compounds. To make the intermetallic compounds uniform and fine, it is effective to raise a rolling depressing rate to crush and disperse the large-sized intermetallic compounds. With regard to Sn, although it has not been clarified yet, the same cause is assumed. That is, the specified elements of the present invention are considered to be Fe, Si, Mn, Mg and Sn present in the intermetallic compounds.

Particularly, the effect of Fe, Si, Mn and Mg is distinct in JIS 3000 series materials, and the effect of Sn is distinct in JIS 1050 series materials.

In the present invention, the occurrence of unevenness in alkaline etching is prevented by specifying a range of dispersion of the abovementioned specific elements in the surface layer portion of the aluminum alloy plate from the surface to the depth of 1 μm, that is usually removed during the course of alkali etching. As a result, in the electrochemical graining treatment performed thereafter, the aluminum alloy plate is not affected by the unevenness occurring in alkali etching. Thus, the support for the lithographic printing plate of the present invention is characterized that the surface thereof is uniform and has no appearance defect such as unevenness in the form of streaks.

If the surface layer portion from the surface to the depth of 1 μm is dissolved during alkaline etching, the dissolved portion turns out to be about 2.7 g/m$^2$. Here, if the dispersion of contents of each element in the surface layer portion from the surface to the 1 μm is too high, not only in the case where the amount of the portion of about 2.7 g/m$^2$ or smaller is dissolved during alkali etching, but also in the case where the amount of the portion of about 2.7 g/m$^2$ or larger is dissolved, the dispersion of contents of each element, seen in the case where 2.7 g/m$^2$ of the surface layer portion from the surface to the depth of 1 μm is dissolved, affects a dissolving rate, thus causing the unevenness. Therefore, for example, in the case where an amount of about 5.5 g/m$^2$ is dissolved during alkali etching before performing the electrochemical graining treatment, in other words, in the case where the portion from the surface to the depth of about 2 μm is dissolved, the dispersion of contents of each element in the surface layer portion from the surface to the depth of 1 μm not only the dissolving rate of the surface layer portion from the surface part to the depth of 1 mm but also the dissolving rate of the portion located at the depth of 1 μm to 2 μm from the surface. The unevenness occurring during alkaline etching is likely to become a cause of unevenness at the time of the electrochemical graining treatment.

The present inventors, through the obtained knowledge mentioned above, have attained a support for a lithographic printing plate of the present invention having no appearance defect such as unevenness in the form of streaks at the time of an electrochemical graining treatment and also having excellent homogeneity of pits by setting dispersion of contents of each element in a surface layer portion of an aluminum alloy plate from a surface thereof to a depth of 1 μm in a specified range.

Note that, a lower limit of dispersion of content of each element in the surface layer portion from the surface to the depth of 1 μm is not particularly limited; however, since it is difficult to make the lower limit of the dispersion lower than 2% in terms of manufacturing and cost, the dispersion is preferred to be 2% or higher. Therefore, a preferred range of dispersion of content of each element in the surface layer portion from the surface to the depth of 1 μm is 2 to 50%.

Also, an aluminum alloy plate used for a support for a lithographic printing plate of the present invention preferably has dispersion of 30% or lower, more preferably 20% or lower, for each element, the dispersion being defined by the equation (1) below with regard to contents of Fe, Si, Mn, Mg and Sn in a portion located at the depth of 2 μm to 5 μm from the surface thereof:

$$\text{dispersion}(\%)=(\text{maximum value}-\text{minimum value})/\text{average value}\times 100(\%) \quad (1),$$

where, the maximum, minimum and average values are determined in the same manner as the above-described case of the surface layer portion.

When the dispersion of the contents of each element in the portion located at the depth of 2 to 5 μm from the surface is in the above-described range, in addition to the situation that the dispersion of the contents of each element in the surface layer portion from the surface to the depth of 1 μm is 50% or lower, the homogeneity of the pits is further improved since the unevenness is not likely to occur during the electrochemical graining treatment.

The portion located at the depth of 2 μm to 5 μm from the surface usually occupies most part of the portion which is subjected to the electrochemical graining treatment after removing a surface of the plate by alkali etching. Thus, the dispersion of the contents of each element in the portion located at the depth of 2 μm to 5 μm from the surface has an influence on the electrochemical grain property, thus causing the occurrence of the unevenness in the electrochemical graining treatment.

Therefore, when the dispersion of the contents of each element in the portion located at the depth of 2 μm to 5 μm from the surface is in the above-described range, the appearance defect such as unevenness in the form of streaks is not likely to occur, and the homogeneity of the pits is further improved.

Note that, a lower limit of dispersion of content of each element in the portion located at the depth of 2 μm to 5 μm from the surface is not particularly limited; however, but since it is difficult to make the lower limit of the dispersion lower than 2% in terms of manufacturing and cost, the dispersion is preferred to be 2% or higher. Therefore, a preferred range of dispersion of content of each element in the portion located at the depth of 2 μm to 5 μm from the surface is 2 to 30%.

An aluminum alloy plate used for the present invention is not particularly limited except as long as dispersion of content of each element in a surface layer portion from the abovementioned surface to 1 μm is 2% to 50%, and preferably, dispersion of content of each element in the portion located at a depth of 2 μm to 5 μm from the surface thereof is 2% to 30% in addition.

As such an aluminum alloy plate, JIS 1050 material, JIS 1100 material, JIS 1070 material, JIS 3000 series material (e.g., an Al—Mg series alloy and an Al—Mn—Mg series alloy), an Al—Zr series alloy and an Al—Mg—Si series alloy can be listed as examples.

As JIS 1050 material, the one described in the followings can be listed-as examples: JP 59-153861 A, JP 61-51395 A, JP 62-146694 A, JP 60-215725 A, JP 60-215726 A, JP 60-215727 A, JP 60-215728 A, JP 61-272357 A, JP 58-11759 A, JP 58-42493 A, JP 58-221254 A, JP 62-148295 A, JP 4-254545 A, JP 4-165041 A, JP 3-68939 B, JP 3-234594 A, JP 1-47545 B, JP 62-140894 A, JP 1-35910 B and JP 55-28874 B.

As an Al—Mg series alloy of JIS 3000 series material, the one described in the followings can be listed as examples: JP 62-5080 B, JP 63-60823 B, JP 3-61753 B, JP 60-203496 A, JP 60-203497 A, JP 3-11635 B, JP 61-274993 A, JP 62-23794 A, JP 63-47347 A, JP 63-47348 A, JP 63-47349 A, JP 64-61293 A, JP 63-135294 A, JP 63-87288 A, JP 4-73392 B, JP 7-100844 B, JP 62-149856 A, JP 4-73394 B, JP 62-181191 A, JP 5-76530 B, JP 63-30294 A, JP 6-37116 B, JP 2-215599 A, JP 61-201747 A, JP 60-230951 A, JP 1-306288 A, JP 2-293189 A, JP 54-42284 B, JP 4-19290 B, JP 4-19291 B, JP 4-19292 B, JP 61-35995 A, JP 64-51992 A, U.S. Pat. No. 5,009,722, U.S. Pat. No. 5,028,276 and JP 4-226394 A.

As an Al—Mn—Mg series alloy of JIS 3000 series material, the one described in the followings can be listed as examples: JP 62-86143 A, JP 3-222796 A, JP 63-60824 B, JP 60-63346 A, JP 60-63347 A, EP 223737 A, JP 1-283350 A, U.S. Pat. No. 4,818,300 and DE 1929146.

In the present invention, an aluminum alloy plate exemplified above or other-aluminum alloy plates with above-described dispersion of content of each element in a surface layer portion from the surface to a depth of 1 $\mu$m being 2 to 50%, or the ones additionally with dispersion of content of each element in a portion located at a depth of 2 $\mu$m to 5 $\mu$m from the surface is 2 to 30% are used.

In order to obtain the above-described aluminum alloy plate, the following method can typically be employed. First, a melt of aluminum alloy adjusted to have specified contents of alloy ingredients is purified and cast by conventional methods. In the purification step, hydrogen, other unwanted gases and solid impurities in the melt are removed. The examples of purification process to remove the unwanted gases are fluxing process and degassing process using argon gas, chloride gas or the like. The examples of purification process to remove the solid impurities are filtering process using a so-called "rigid" media filter such as a ceramic tube filter or a ceramic foam filter, a filter using alumina flakes, alumina balls or some other filtering media, glass cloth filter or the like. Alternatively, the purification process can be applied by the combination of degassing process and filtering process.

Then, the aluminum alloy molten metal is cast by either a casting method using a fixed mold represented by a DC casting method or a casting method using a movable mold represented by a continuous casting method. In case of the DC casting method, a cast ingot with a board thickness of 300 to 800 mm is produced. Here, according to the conventional method, 1 to 30 mm of a surface layer, preferably 1 to 10 mm of the same, is shaved off by scalping. Thereafter, a soaking treatment is carried out according to need. In a case where the soaking treatment is conducted, a heat treatment at a temperature of 450 to 620° C. for duration of 1 to 48 hours is carried out in order to prevent the intermetallic compounds from becoming large-sized. If the time taken for performing the soaking method is less than an hour, treatment effect of the soaking treatment may not be sufficient.

Thereafter, the resultant aluminum alloy is subjected to hot rolling and cold rolling to form a rolled plate of an aluminum alloy plate. A starting temperature of 350 to 500° C. is appropriate for the hot rolling. An intermediate annealing can be conducted at any time before, after or middle of the cold rolling. The condition may be either to heat at 280 to 600° C. for 2 to 20 hours, preferably at 350 to 500° C. for 2 to 10 hours, in a batch annealing furnace, or to heat at a temperature of 400 to 600° C. for 6 minutes or shorter, preferably at 450 to 550° C. for 2 minutes or shorter in a continuous annealing furnace. It is also possible to make a crystal structure fine by heating at a temperature-rising speed of 10° C./sec. or more using the continuous annealing furnace.

Through the processes thus far, the dispersion of the content of above specified elements in the surface layer portion of the aluminum alloy plate can be made to be 2 to 50%. It is particularly important to evenly disperse the intermetallic compounds. And, an aluminum alloy plate completed in a specified thickness of, for example, 0.1 to 0.5 mm may be improved in its flatness by using a level controlling apparatus such as a roller leveler or a tension level controller. Also, the resultant aluminum alloy plate usually goes through a slitter line so as to be processed into an aluminum alloy plate having a specified board width.

The method of manufacturing a support for a lithographic printing plate of the present invention is characterized in that a surface of an aluminum alloy plate having dispersion of content of the above-described specified elements in the specified range is subjected to alkaline etching followed by an electrochemical graining treatment (hereinafter, also referred to as "electrolytic graining treatment"). The manufacturing processes of the support for a lithographic printing plate of the present invention may include various processes other than the alkaline etching and the electrochemical graining treatment as seen below.

An aluminum alloy plate used in the present invention is subjected to an alkaline etching and a graining treatment including an electrolytic graining treatment so as to be made into a support for a lithographic printing plate. Only the electrolytic graining treatment can be performed or a combination of the electrolytic graining treatment and at least one of a mechanical graining treatment and a chemical graining treatment can be performed as the graining treatment.

The aluminum alloy plate used in the present invention is subjected to alkaline etching before being subjected to the electrolytic graining treatment. In this case, it is preferable that a desmutting treatment be performed between the alkali etching and the electrolytic graining treatment.

Also, the aluminum alloy plate used in the present invention may be subjected to another alkaline etching after being subjected to the electrolytic graining treatment. In this case, too, it is preferable that the desmutting treatment be performed after the alkaline etching.

The mechanical graining treatment is generally performed for the purpose of making an average surface roughness of the surface of the aluminum alloy plate 0.35 to 1.0 $\mu$m. In the present invention, conditions for the mechanical graining treatment are not particularly limited; ball graining, wire graining, brush graining and liquid honing methods can be used, for example. Also, the mechanical graining treatment can be carried out according to the methods described in JP 6-135175 A and JP 50-40047 B. By performing the mechanical graining treatment, it is usually possible to make the aluminum alloy plate have an arithmetic mean roughness ($R_a$) of 0.35 to 1.0 $\mu$m. Through the mechanical graining treatment, water receptivity of non-image areas during printing can be enhanced. Meanwhile, the chemical graining treatment can also be carried out according to known methods without any particular limitation. Examples of the chemical graining treatment include: immersion of the aluminum alloy plate into an alkaline bath; spraying an alkaline solution onto the aluminum alloy plate; and applying the alkaline solution thereon.

Alkaline etching is performed for a purpose of removing rolling oil, stains and natural oxide film on the surface of the foregoing aluminum alloy plate. In the case where the mechanical graining treatment is conducted, alkali etching is performed for a purpose of dissolving edge portions of unevenness generated through the mechanical graining treatment such that the aluminum alloy plate obtains a surface with smooth waves.

An alkaline etching is a chemical etching performed in an alkaline aqueous solution. As alkaline used in the alkaline aqueous solution, sodium hydroxide and potassium hydroxide, sodium tertiary phosphate, sodium aluminate, sodium carbonate and the like as described in JP 57-16918 A, can be listed, and these are used alone or in combination. Concentration of the alkaline aqueous solution is preferably 5 to 30 wt %, and more preferably, 20 to 30 wt %. Concentration of aluminum dissolved in the alkaline aqueous solution is preferably 0.5 to 30 wt %. Etching by the alkaline aqueous solution is preferably conducted at a liquid temperature of 25 to 90° C. for 1 to 120 seconds. The amount of etching is preferably dissolution of 1 to 30 g/m$^2$, more preferably 1.5 to 20 g/m$^2$, and particularly preferably 2 to 10 g/m$^2$.

As described above, the aluminum alloy plate used in the present invention has dispersion of content of specified elements in a specified range. Thus, unevenness is not likely to occur during alkali etching. Accordingly, there will be no occurrence of appearance defect such as unevenness in the form of streaks on the surface by the electrolytic graining treatment conducted after alkaline etching or damage of homogeneity of the pits by the electrolytic graining treatment.

Typically, alkaline-insoluble substance (smut) is generated on the surface of the aluminum alloy plate by alkaline etching. In this case, it is desirable to remove the smut by conducting a desmutting treatment with phosphoric acid, nitric acid, sulfuric acid, hydrochloric acid, chromic acid or a mixed acid including two or more kinds of acid listed above. Duration of desmutting is preferably 1 to 30 seconds. Liquid temperature in the desmutting treatment is at a room temperature to 70° C.

The electrolytic graining treatment is suited to produce a lithographic printing plate with excellent printability as it easily provides fine unevennesses (pits) onto the surface of the aluminum alloy plate. The electrolytic graining treatment is carried out in an aqueous solution mainly containing nitric acid or hydrochloric acid by using a direct current or an alternating current.

Crater-shaped or honeycomb-shaped pits with an average diameter of about 0.2 to 20 $\mu$m can be generated by the electrolytic graining treatment formed on the surface of the aluminum alloy plate at surface ratio of 30 to 100%. The pits serve to improve resistance to stain of the non-image area (scum resistance) and press life. Amount of electricity necessary for forming sufficient pits on the surface, that is the product of the electric current and the duration of current-carrying, is an important condition in the electrolytic graining. It is desirable in terms of energy saving that sufficient pits be formed with small amount of electricity. In the present invention, the conditions of the electrolytic graining treatment are not limited, and the treatment can be conducted under general conditions. In any case, required amount of electricity can be reduced drastically.

In the present invention, there will be no occurrence of appearance defect such as unevenness in the form of streaks on the surface by electrolytic graining treatment or damage of homogeneity of the pits by the electrolytic graining treatment since unevenness is not likely to occur during alkali etching. Also, making the dispersion of the content of the specified elements in the portion located at the depth of 2 $\mu$m to 5 $\mu$m from the surface set in the specified range further improves homogeneity of the electrolytic graining treatment itself.

In a preferred embodiment of the support for a lithographic printing plate of the present invention, alkaline etching is further carried out after the above-described electrolytic graining treatment.

The alkaline etching of this time is conducted for the following purposes: quick removal of the smut substances formed during the electrolytic graining treatment; and dissolution of edge portion of the pits formed during the electrolytic graining treatment so as to make the edge portion thereof smooth. Amount of etching is preferably dissolution of 0.01 to 10 g/m$^2$, more preferably, 0.04 to 4 g/m$^2$. Composition of the aqueous solution used in etching, a liquid temperature, time taken for the treatment and the like are selected from the scope of the above-mentioned alkaline etching before the electrolytic graining treatment.

It is preferable that a desmutting treatment is further conducted. Conditions for the desmutting treatment are selected from the scope of the above-mentioned desmutting treatment, which is after alkaline etching before electrolytic graining treatment.

In succession to the above-described alkaline etching and electrolytic graining treatment, and other treatments conducted depending on necessity, the aluminum alloy plate is generally subjected to an anodizing treatment to form an anodized layer in order to enhance the abrasion resistance of the surface thereof. It is preferable to perform the anodizing treatment also in the present invention. An anodized layer can be formed by immersing an aluminum alloy plate as an electrode into an electrolytic solution and allowing an electric current to pass therein.

For the electric current applied in the anodizing treatment, electric currents with various waveforms, such as a direct current and an alternating current, is selected according to the purpose. For an electrolyte used in the anodizing treatment, any electrolyte that forms a porous oxide layer can be used, and in general, sulfuric acid, phosphoric acid, oxalic acid, chromic acid or a mixed acid thereof is used. Concentration of the electrolytes may be appropriately determined properly by the kind of electrolyte used. Anodizing conditions vary with the electrolyte used; therefore; it is not possible to specifically determine the conditions. In general, however, it is sufficient that the electrolyte concentration is in a range of 1 to 80 wt % in solution, the electrolytic solution temperature is in a range of 5 to 70° C., an electric current density is in a range of 1 to 60 A/dm$^2$, a voltage is in a range of 1 to 100V, and duration of electrolysis is in a range of 10 seconds to 5 minutes. An amount of the anodized layer formed by the anodizing treatment is, in general, preferable 1 to 6 g/m$^2$.

After the anodizing treatment, a sealing treatment may be performed if desired. The sealing treatment is carried out by a method such as immersing the anodized aluminum alloy plate in hot water or a hot solution of inorganic salt or organic salt, exposing the anodized aluminum alloy plate to a steam bath, and the like.

Also, an interface control treatment such as a treatment for water wettability may be carried out after the anodizing treatment if desired.

The interface control treatment includes an alkaline metal silicate (for example, a sodium silicate aqueous solution) method described in U.S. Pat. Nos. 2,714,066, 3,181,461, 3,280,734 and 3,902,734. In this method, the support is subjected to an immersion treatment in a sodium silicate aqueous solution or to an electrolytic treatment in the solution. Other methods such as a treatment with potassium zirconate fluoride described in JP 36-22063 B, and a treatment with polyvinyl phosphonic acid described in U.S. Pat. Nos. 3,276,868, 4,153,461 and 4,689,272 are used.

With respect to details of each treatment described in each section above, known conditions can be employed appropriately. Also, the contents of literatures cited herein are incorporated herein by reference.

The support for a lithographic printing plate of the present invention is thus obtained. The support for a lithographic printing plate of the present invention is preferably used since no appearance defect such as unevenness in the form of streaks exists thereon and is excellent printing performance as the pit homogeneity thereon is excellent. Also, according to a method of manufacturing a support for a lithographic printing plate of the present invention, it is possible to produce surely a support for a lithographic printing plate with no appearance defect such as unevenness in the form of streaks and with excellent pit homogeneity.

To make the support for a lithographic printing plate into a presensitized plate, a photosensitive agent may be applied onto the surface of the support and dried to form a photosensitive layer. The photosensitive agent is not particularly limited, and any photosensitive agent used in common for a photosensitive presensitized plate can be used. Then, an image is printed onto the printing plate by using a lith type film and development is performed. By applying gum onto the resultant printed plate thereafter, a printing plate attachable to a printing machine is complete. In a case where the printing plate has a photosensitive layer of high sensitivity, the image can be printed directly by laser.

For the photosensitive agent, any photosensitive agent whose solubility or bloating tendency to a developer changes before and after the exposure may be used. Representative photosensitive agents are listed below.

(1) A Photosensitive Layer Comprising an o-quinonediazide Compound

As a positive photosensitive compound, an o-quinonediazide compound represented by an o-naphthoquinonediazide compound is presented. The o-naphthoquinonediazide compound is preferably an ester of 1.2-diazonaphthoquinone sulfonic chloride and pyrogallol-acetone resin as described in JP 43-28403 B. Ester of 1,2-diazonaphthoquinone sulfonic chloride and phenol-formaldehyde resin as described in U.S. Pat. No. 3,046,120 and U.S. Pat. No. 3,188,210 is also preferable. Other known o-naphthoquinonediazide compounds may also be used.

A particularly preferred o-naphthoquinonediazide compound is a compound obtained through a reaction between a polyhydroxy compound with a molecular weight of 1,000 or less and 1,2-diazonaphthoquinone sulfonic chloride. Herein, it is preferable that 1,2-diazonaphthoquinone sulfonic chloride at a ratio of 0.2 to 1.2 equivalent weight, particularly at a ratio of 0.3 to 1.0 equivalent weight, is reacted with a hydroxy group of a polyhydroxy compound of 1 equivalent weight. As 1,2-diazonaphthoquinone sulfonic chloride, 1,2-diazonaphthoquinone-5-sulfonic chloride is preferred, but 1,2-diazonaphthoquinone-4-sulfonic chloride may also be used.

The o-naphthoquinonediazide compound becomes a mixture of ones with variously different positions of the substitute and amounts of the introduction of 1,2-diazonaphthoquinone sulfonic chloride. It is preferred that the ratio of the compound all hydroxy group s converted to 1,2-diazonaphthoquinone sulfonic ester (content of fully esterified one) occupying in the mixture is 5 mol % and more, in particular, 20 to 90 mol %.

Also, instead of using the o-naphthoquinonediazide compound, it is possible to use a polymer containing o-nitrocarbinol ester group as described in JP 56-2696 B as an example of positively acting photosensitive compound. In addition, a combination system of a compound that generates an acid by photodecomposition and a compound containing —C—O—C— group or —C—O—Si— group that is dissociated by acid may also be used. Examples are as follows: a combination of the compound that generates an acid by photodecomposition and acetal or an O,N-acetal compound (JP 48-89003 A); a combination of the compound and orthoester or an amide acetal compound (JP 51-120714 A), a combination of the compound and a polymer containing an acetal or a ketal group on the main chain (JP 53-133429 A); a combination of the compound and an enol ether compound (JP 55-12995 A); a combination of the compound and a N-acyl iminocarbon compound (IP 55-126236 A); a combination of the compound and a polymer containing an orthoester group on the main chain (JP 56-17345 A); a combination of the compound and a silylester compound (JP 60-10247 A); and a combination of the compound and a silylether compound (JP 60-37549 A and JP 60-121446 A).

The ratio of the positive photosensitive compound (including the aforesaid combination systems) in the photosensitive composition in the photosensitive layer is preferably 10 to 50 wt %, more preferably, 15 to 40 wt %.

Although the o-quinonediazide compound alone may compose a photosensitive layer, it is preferred that the O-quinonediazide compound is used together with alkaline water soluble resin as a binder. The alkaline water soluble resin includes novolac resin, and examples of alkaline water soluble polymers that can be contained in the alkali water include: phenol-formaldehyde resin; cresol-formaldehyde resin such as m-cresol-formaldehyde resin, p-cresol-formaldehyde resin, m-/p-cresol mixture formaldehyde resin, phenol/cresol mixture (any of in-, p-, and m-/p-mixtures) formaldehyde resin; phenol modified xylene resin; polyhydroxy styrene; polyhydroxystyrenehalide; acrylic resin containing phenolic hydroxy group as described in JP 51-34711 A; and acrylic resin containing sulfonamide group described in JP 2-866 A and urethane resin. Alkaline water soluble resins with a weight average molecular weight ranging from 500 to 200,000 and a number average molecular weight ranging from 200 to 60,000 are preferred.

Although the o-quinonediazide compound alone may compose a photosensitive layer, it is preferred that the O-quinonediazide compound is used together with alkaline water soluble resin as a binder. The alkaline water soluble resin includes novolac resin, and examples of alkaline water soluble polymers that can be contained in the alkali water include: phenol-formaldehyde resin; cresol-formaldehyde resin such as m-cresol-formaldehyde resin, p-cresol-formaldehyde resin, m-/p-cresol mixture formaldehyde resin, phenol/cresol mixture (any of in-, p-, and m-/p-mixtures) formaldehyde resin; phenol modified xylene resin; polyhydroxy styrene; polyhydroxystyrenehalide; acrylic resin containing phenolic hydroxy group as described in JP 51-34711 A; and acrylic resin containing sulfonamide group described in JP 2-866 A and urethane resin. Alkaline water soluble resins with a weight average molecular weight ranging from 500 to 200,000 and a number average molecular weight ranging from 200 to 60,000 are preferred.

The photosensitive composition can contain a cyclic acid anhydride for enhancing the sensitivity, a printing out agent for obtaining a visible image immediately after the exposure, dye as an image coloring agent and other fillers. The following cyclic acid anhydrides are used as described in U.S. Pat. No. 4,115,128: phthalic anhydride, tetrahydrophthalic anhydride, hexahydrophthalic anhydride, 3,6-endo-oxy-$\Delta^4$-tetrahydrophthalic anhydride, tetrachlorophthalic anhydride, maleic anhydride, chloromaleic anhydride, $\alpha$-phenylmaleic anhydride, succinic anhydride, and pyromellitic anhydride. The cyclic acid anhydride can enhance the sensitivity as high as 3 times at a maximum by being contained at a ratio of 1 to 15 wt % with regard to the total weight of the composition. The printing out agent for obtaining the visible image immediately after the exposure can be represented by a combination of a photosensitive compound which releases an acid by being exposed and organic dye capable of forming salt.

Specifically, a combination of an o-naphthoquinonediazide-4-sulfonic acid halogenide and salt-forming organic dye as described in JP 50-36209 A and JP 53-8128 A, and a combination of a trihalomethyl compound and salt-forming organic dye as described in JP 53-36233 A, JP 54-74728 A, JP 60-3626 A, JP 61-143748 A, JP 61-151644 A and JP 63-58440 A can be presented. With regard to the image coloring agent, dyes other than above-mentioned salt-forming organic dyes may be used. Preferable dyes including the salt-forming organic dyes are oil soluble dyes or basic dyes.

Specifically, the followings can be listed as preferable dyes: Oil Yellow #101, Oil Yellow #103, Oil Pink #312, Oil Green BG, Oil Blue BOS, Oil Blue #603, Oil Black BY, Oil Black BS, and Oil Black T-505 (all of the above manufactured by Orient Chemical Industries, Ltd.); Victoria Pure Blue; Crystal Violet (CI42555); Methyl Violet (CI42535); Rhodamine B (CI45170B); Malachite Green (CI42000); and Methylene Blue (CI52015). Dyes described in JP 62-293247 A are particularly preferred.

The photosensitive composition is dissolved in a solvent that dissolves above-described various components and applied onto the support. The solvent includes ethylene dichloride, cyclohexanone, methyl ethyl ketone, ethylene glycol monomethyl ether, ethylene glycol monoethyl ether, 2-methoxyethyl acetate, 1-methoxy-2-propanol, 1-methoxy-2-propyl acetate, toluene, methyl acetate, methyl lactate, ethyl lactate, dimethyl sulfoxide, dimethylacetamide, dimethylformamide, water, N-methylpyrrolidone, tetrahydrofurfuryl alcohol, acetone, diacetone alcohol, methanol, ethanol, isopropanol, diethylene glycol and dimethyl ether. The foregoing solvents may be mixed for use.

Amount of above-described components occupying in the solution (a solid content) is 2 to 50 wt %. Amount of the photosensitive composition to be applied onto the support is varied according to application purpose. However, as for the photosensitive presensitized plate, it is generally preferred that the solid content is 0.5 to 3.0 g/m$^2$. As the applied amount decreases, the photosensitivity increases; however, the physical properties of the photosensitive film become lowered.

The photosensitive composition may contain a surfactant, such as a fluorine-containing surfactant, for example, as described in JP 62-170950 A such that coating properties are improved. Content is preferably 0.01 to 1 wt %, more preferably, 0.05 to 0.5 wt % of the total photosensitive composition.

(2) A Photosensitive Layer Comprising Diazo Resin and a Binder

As a negative action type photosensitive diazo compound, a condensation product of diphenylamine-p-diazonium salt, which is a reaction product of diazonium salt and an organic condensing agent having reactive carbonyl groups such as aldol or acetal, with formaldehyde (so-called photosensitive diazo resin) is preferably used. The diazonium salt preferably used here is described in U.S. Pat. Nos. 2,063,631 and 2,667,415.

Other useful condensation diazo compounds are described in JP 49-48001 B, JP 49-45322 B, JP 49-45323 B and the like. The photosensitive diazo compound of this type is usually obtained in a form of water-soluble inorganic salt, and thus can be applied as an aqueous solution. Also it is possible to use a substantially water-insoluble photosensitive diazo resin which is a product resulting from a reaction between the water soluble diazo compound and an aromatic compound or an aliphatic compound having one or more phenolic hydroxy group sulfonic acid group or both of the above. A method of reaction is described in JP 47-1167 B.

Content of the diazo resin should be 5 wt % to 50 wt % in the photosensitive layer. As the content decreases, the photosensitivity is of course increased; however, the stability with time is lowered. The optimum content of the diazo resin is about 8 wt % to 20 wt %. While various polymers can be used as the binder, preferred are those which have functional groups such as hydroxy group, amino group, carboxy group, amide group, sulfonamide group, active methylene group, thioalcohol group and epoxy group.

Specifically, the followings are included in the binder: shellac described in GB 1350521 B; a polymer containing hydroxyethyl (meth) acrylate unit as a main repeating unit such as described in GB 1460978 B and U.S. Pat. No. 4,123,276; polyamide resin described in U.S. Pat. No. 3,751,257; phenol resin and polyvinyl acetal resin such as polyvinyl formal resin and polyvinyl butyral resin, for example, as described in GB 1074392 B; linear polyurethane resin as described in U.S. Pat. No. 3,660,097; polyvinyl alcohol phthalate resin; epoxy resin obtained from bisphenol A and epichlorohydrin; polymer containing an amino group such as polyaminostyrene and polyalkylamino (meth)acrylate; and cellulose derivatives such as cellulose acetate, cellulose alkyl ether and cellulose acetate phthalate.

Into the composition comprising diazo resin and a binder, additives such as a pH indicator as described in GB 1041463 B, phosphoric acid and dyes described in U.S. Pat. No. 3,236,646 can be contained.

The thickness of the photosensitive layer is 0.1 to 30 $\mu$m, more preferably, 0.5 to 10 $\mu$m. Amount of the photosensitive layer (solid content) provided on the support is about 0.1 to about 7 g/m$^2$, preferably 0.5 to 4 g/m$^2$. After the presensitized plate is subjected to an image exposure, a resin image is formed by a treatment including development in accordance with the conventional method. For example, in case of positive photosensitive presensitized plate having a photosensitive layer (A), the photosensitive layer of the exposed portion is removed by carrying out development with an aqueous alkaline solution as described in U.S. Pat. No. 4,259,434 and JP 3-90388 A after the exposure of the image, and thus a lithographic printing plate is obtained.

In case of negative photosensitive presensitized plate having a photosensitive layer (B) comprising diazo resin and a binder, non-exposed portion of the photosensitive layer is removed by carrying out development with a developer such as the one described in U.S. Pat. No. 4,186,006 after the exposure of the image and thus a lithographic printing plate is obtained. Also, in case of a negative photosensitive presensitized plate as described in JP 5-2273 A or JP 4-219759 A, the development can be carried out with an aqueous solution of alkaline metal silicate.

EXAMPLES

The following examples are provided for the purpose of further illustrating the present invention but are in no way to be taken as limiting.

1. Manufacture of Support for Lithographic Printing Plate (Examples 1 to 7 and Comparative Examples 1 to 11)

As an aluminum alloy plate, JIS 3005 materials and JIS 1050 materials, each having a different composition, were subjected to an alkali etching and rinsing, followed by a desmutting treatment where nitric acid was sprayed on to the plates. The plates were subjected to another rinsing followed by an electrolytic graining treatment. Further, after yet another rinsing, the plates were subjected to another alkali etching. Still further, after another rinsing, the plates were subjected to the desmutting treatment where sulfuric acid was sprayed to the plates. Thus, supports for lithographic printing plates were obtained.

Conditions for each treatment were as seen below.

In the first etching, a solution of sodium hydroxide with a concentration of 26 wt % and aluminum ion with a concentration of 6.5 wt % at a temperature of 65° C. was used as an etchant, and the etching was performed until the amount of dissolved Al became 8.0 g/m$^2$.

In the second alkali etching, a solution of sodium hydroxide with a concentration of 5 wt % and aluminum ion with a concentration of 0.5 wt % at a temperature of 35° C. was used as an etchant, and the etching was performed until the amount of dissolved Al become 0.1 g/m$^2$.

In the electrolytic graining treatment, a solution of sulfuric acid with a concentration of 1 wt % and aluminum ion with a concentration of 0.5 wt % as an electrolytic solution was used, and the treatment was performed by using an alternating current until the total quantity of electricity became 180 C/dm$^2$.

2. Dispersion of Content of Fe, Si, Mn, Mg and Sn at a Specified Depth of the Aluminum Alloy Plate For each aluminum alloy plate used in the above, dispersion defined by the equation (1) below with regard to contents of Fe, Si, Mn, Mg and Sn in the surface layer portion from the surface to a depth of 1 μm and in a portion located at a depth of 2 μm to 5 μm from the surface was obtained:

$$\text{dispersion}(\%)=(\text{maximum value}-\text{minimum value})/\text{average value}\times 100(\%) \quad (1),$$

where, the maximum, minimum and average values were determined based on eight pieces of element content data resulting from excluding the largest and smallest values from ten pieces of element content data obtained by performing an element analysis at ten locations. Here, the element analysis was carried out as follows. First, each of the aluminum alloy plates was sequentially subjected to an alkali etching, rinsing and a desmutting treatment so as to expose respective surfaces at a depth of 0.5 μm and 1 μm from the surface. Then the exposed surfaces were rinsed in acetone and dried. The analysis then was performed by using the solid state light emission analyzer at ten locations, the measurement locations being separated from each other by a distance of no less than 2 cm. The resulting data of 0.5 m was regarded as a representative data for the surface layer portion from the surface to the depth of 1 μm. since there was no substantial difference between the resulting values of the depths of 0.5 μm and 1 μm. Similarly, the elemental analysis was performed for three surfaces at the depth of 2.0 μm, 4.0 μm and 5.0 μm respectively in order to obtain data for the portion at the depth of 2 μm to 5 μm from the surface. Here, the data for the depth of 4.0 μm was selected as a representative data since there was no substantial differences between the resulting data.

3. Evaluation of Supports for Lithographic Printing Plates

Unevenness in the form of streaks on surface and homogeneity of surface pits of the supports for lithographic printing plates obtained in each Example and Comparative Example were evaluated.

(1) Unevenness in the Form of Streaks on Surface

Unevenness in the form of streaks on surfaces of supports for lithographic printing plates were visually observed under a combination of white light and yellow light and evaluated in five scales. Surfaces with no observed unevenness in the form of streaks were marked as ○, those with many unevenness in the form of streaks were marked as X, and those between the two were marked as ○Δ, Δ, and ΔX in the order of less unevenness in the form of streaks.

(2) Homogeneity of Surface Pits (Uniformity of Electrolytic Grained Surface)

Surface pits of supports for lithographic printing plates were observed by photographs of 1500 magnifications using a scanning electron microscope (T220A, manufactured by JEOL, Ltd.) and evaluated in five scales. The evaluated pits were marked ○, ○Δ, Δ, ΔX and X in the order from uniformity to lack of uniformity.

Results of dispersion with regard to contents of Fe, Si, Mn, Mg and Sn at specified depths of aluminum alloy plates used in each support for lithographic printing plate and unevenness in the form of streaks on surface and homogeneity of the surface pits of each support for lithographic printing plate were shown in Table 1.

In the supports for lithographic printing plates of the present invention, the dispersion is 50% or lower with regard to contents of Fe, Si, Mn, Mg and Sn in the surface layer portion from the surface to the depth of 1 μm of the aluminum alloy plates used. It can be seen that there are no unevenness in the form of streaks and the pits are homogeneous (Examples 1 to 7). Especially, when the dispersion with regard to contents of Fe, Si, Mn, Mg and Sn in the portion located at the depth of 2 μm to 5 μm from the surface of the aluminum alloy plates used is 30% or lower, it can be seen that the supports are superior to the others in terms of no unevenness in the form of streaks and homogeneity of the pits (Examples 1, 2, 3, 5 and 6).

On the other hand, when the dispersion with regard to contents of Fe, Si, Mn, Mg and Sn in the surface layer portion from the surface to the depth of 1 μm of the aluminum boards used is 50% or higher, the unevenness in the form of streaks occurs and the pit homogeneity are poor (Comparative Examples 1 to 11).

TABLE 1

| | Aluminum alloy plate | | | | Surface of the support after electrolytic graining | |
|---|---|---|---|---|---|---|
| | Material | Element indicating the greatest dispersion | Dispersion in the surface layer portion from the surface to the depth of 1 μm (%) | Dispersion in the portion located at the depth of 2 μm to 5 μm from the surface (%) | Unevenness in the form of streaks | Pit homogeneity |
| Example 1 | JIS 3005 material | Si | 23 | 15 | ○ | ○ |
| Example 2 | JIS 3005 material | Fe | 38 | 20 | ○ | ○ |
| Example 3 | JIS 3005 material | Mn | 30 | 17 | ○ | ○ |
| Example 4 | JIS 3005 material | Mg | 40 | 32 | ○Δ | ○Δ |
| Example 5 | JIS 3005 material | Sn | 34 | 27 | ○ | ○ |
| Example 6 | JIS 3005 material | Mg | 40 | 17 | ○ | ○ |
| Example 7 | JIS 1050 material | Sn | 38 | 32 | ○ | ○ |
| Comparative Example 1 | JIS 3005 material | Si | 76 | 35 | X | X |
| Comparative Example 2 | JIS 3005 material | Fe | 64 | 31 | X | X |
| Comparative Example 3 | JIS 3005 material | Mn | 52 | 33 | X | X |
| Comparative Example 4 | JIS 3005 material | Mg | 60 | 38 | X | X |
| Comparative Example 5 | JIS 3005 material | Sn | 82 | 22 | X | X |
| Comparative Example 6 | JIS 3005 material | Si | 75 | 25 | X | ΔX |
| Comparative Example 7 | JIS 3005 material | Fe | 64 | 17 | X | ΔX |
| Comparative Example 8 | JIS 3005 material | Mn | 51 | 19 | X | ΔX |
| Comparative Example 9 | JIS 3005 material | Mg | 58 | 22 | X | ΔX |
| Comparative Example 10 | JIS 3005 material | Sn | 80 | 20 | X | ΔX |
| Comparative Example 11 | JIS 1050 material | Sn | 52 | 20 | ΔX | ΔX |

The support for the lithographic printing plate of the present invention has no appearance defect such as unevenness in the form of streaks and is excellent in the pit homogeneity.

Also, according to the method of manufacturing the support for the lithographic printing plate of the present invention, the method of the present invention is excellent in production efficiency and thus effective since it is possible to reliably produce the support for the lithographic printing plate with no appearance defect such as unevenness in the form of streaks and with excellent pit homogeneity.

What is claimed is:

1. A method of manufacturing a support for a lithographic printing plate subjecting an aluminum alloy plate to a dispersion analysis whereby the aluminum alloy plate exhibits dispersion of 50% or lower for each element, the dispersion being defined by an equation (1) below with regard to contents of Fe, Si, Mn, Mg and Sn in a surface layer portion thereof which is from the surface to a depth of 1 μm, and subjecting a surface of the aluminum alloy plate to a surface treatment including alkali etching and an electrochemical graining treatment:

$$\text{dispersion}(\%)=(\text{maximum value}-\text{minimum value})/\text{average value}\times 100(\%) \quad (1),$$

where the maximum, minimum and average values are determined based on eight pieces of element content data resulting from excluding the largest and smallest values from ten pieces of element content data obtained by performing an elemental analysis at ten locations.

2. The method of manufacturing a support for a lithographic printing plate according to claim 1, wherein said aluminum alloy plate is subjected to a further dispersion analysis whereby the aluminum alloy plate exhibits dispersion of 30% or lower for each element, the dispersion being defined by an equation (1) below with regard to contents of Fe, Si, Mn, Mg and Sn in a portion thereof located at a depth of 2 μm to 5 μm from the surface:

$$\text{dispersion}(\%)=(\text{maximum value}-\text{minimum value})/\text{average value}\times 100(\%) \quad (1),$$

where the maximum, minimum and average values are determined based on eight pieces of element content data resulting from excluding the largest and smallest values from ten pieces of element content data obtained by performing an elemental analysis at ten locations.

3. The method of manufacturing a support for a lithographic printing plate according to claim 1, wherein said aluminum alloy plate is made of an Al—Mn—Mg series alloy.

4. The method of manufacturing a support for a lithographic printing plate according to claim 2, wherein said aluminum alloy plate is made of an Al—Mn—Mg series alloy.

* * * * *